US006666604B1

(12) United States Patent
Montagutelli

(10) Patent No.: US 6,666,604 B1
(45) Date of Patent: Dec. 23, 2003

(54) THERMAL PRINTING DEVICE WITH FAST CLOSURE

(75) Inventor: Denis Montagutelli, Paris (FR)

(73) Assignee: A.P.S. Engineering S.A.R.L., Paris (FR)

( * ) Notice: Subject to any disclaimer, the term of this patent is extended or adjusted under 35 U.S.C. 154(b) by 0 days.

(21) Appl. No.: 09/856,155

(22) PCT Filed: Dec. 2, 1999

(86) PCT No.: PCT/FR99/02987

§ 371 (c)(1),
(2), (4) Date: Jun. 1, 2001

(87) PCT Pub. No.: WO00/32404

PCT Pub. Date: Jun. 8, 2000

(30) Foreign Application Priority Data

Dec. 2, 1998 (FR) ..... 98 15726

(51) Int. Cl.[7] ..... B41J 11/04; B41J 11/20

(52) U.S. Cl. ..... 400/649; 400/659; 400/120.16; 347/197

(58) Field of Search ..... 400/649, 648, 400/659, 693, 120.16, 120.17; 347/197, 198

(56) References Cited

U.S. PATENT DOCUMENTS 5,548,318 A * 8/1996 Ro et al. ..... 347/174
6,004,053 A * 12/1999 Petteruti et al. ..... 400/693
6,155,731 A * 12/2000 Bertalan et al. ..... 101/227

FOREIGN PATENT DOCUMENTS

DE 3439028 A * 4/1986 ..... B41J/13/00
EP 372753 A * 6/1990 ..... B41J/11/02
JP 10147023 A * 6/1998 ..... B41J/11/14

* cited by examiner

*Primary Examiner*—Daniel J. Colilla
(74) *Attorney, Agent, or Firm*—Westerman, Hattori, Daniels & Adrian LLP

(57) ABSTRACT

A thermal printing device is capable of being closed by clipping. The device according to the invention includes a printhead 2, a roller 4 integral with a gear assembly, whereon rests the printhead 2 when the device is in the printing position and two orifices 6, 7 on each lateral side of the frame, characterized in that the portion of the orifices 6 and 7 opposite the printhead is so configured as to present a position of unstable equilibrium of the roller when its axis is moving in said orifices 6, 7 when it is subjected to the pressure of the printhead. The invention is applicable to compact devices.

10 Claims, 7 Drawing Sheets

THERMAL PRINTING DEVICE WITH FAST CLOSURE

The present invention concerns a thermal printing device comprising a frame, a thermal printhead flexibly mounted on the frame, a driving roller carried by a cover and integral with a gear assembly, the printhead resting on the roller when the device is in a printing position, and two orifices arranged in each lateral side of the frame, in which ends of a rotation axis of the roller can be inserted, in which the loading and unloading of the paper, and in particular the closure Of its frame, are facilitated.

Printing mechanisms generally consist of a printhead affixed on a frame. The thermal printhead includes a ceramic support bearing the line of heating dots and the chips controlling their power supply. The printhead can pivot relative to the frame, most commonly along an axis parallel to one longitudinal side of the frame. A roller is integral with the frame such that its longitudinal axis is also parallel to one longitudinal side of the frame. The printhead is held in contact with the roller by a spring. The position of the roller must be controlled perfectly in order to obtain good alignment with the thermal head; the printing support usually consists of a roll of paper, one side of which is heat sensitive. This printing roller is driven in rotation by means of a driving roller which is, for its part, actuated by a system of gears and by a small electric motor.

One of the primary difficulties in the use of these mechanisms is performing the introduction of the end of the roll of thermal paper between the roller and the thermal printhead. This loading operation is currently accomplished in several ways.

One simplified system uses the printhead as a cam to lock the head in position.

Another system consists in moving the head away from the roller by means of a lever. Such a system is described, for example, in the document FR-A-2 737 152 and in the document FR-A-2 737 153. The thermal printing mechanism described in these documents includes a frame, a roller, a printhead, means forming a spring to tension the printhead against the roller, and a cam mounted pivotably around one axis of the frame to move the printhead away from the roller. The major disadvantages of these devices are the complexity of the lifting mechanism (cam and lever), the necessity of an additional sensor, usually a switch, to detect the lifting, and the management of the electronics involved.

There are also devices in which the printhead is separated using an element of the frame or a pivoting cover whose movements are relatively complex, as it is first necessary to remove the roller integral with this pivoting element from the printhead before being able to pivot the assembly when the roller is no longer in contact with the head, thus freeing the space to load the paper.

Other devices include means to lock the printhead on the roller, which, when deactivated, for example, by pressing on a mechanical part, release the printhead from the lock and enable opening the mechanism.

A thermal printing device for paper having a thermal printhead working by contact with a roller for driving the paper has been described, wherein the printhead is flexibly supported by a fixed part of the frame whereas the driving roller is carried by a movable frame element articulated on the fixed frame and forming a cover for access to the compartment of the device designed for the paper roll, with the printing device being such that the contact zone of the line of heating dots of the printhead on the paper driving roller is located behind the diameter of the roller passing through the articulation of the movable frame on the fixed frame when the cover is closed in the direction of closing the cover.

This device presents the major disadvantage of kg the closing of the mechanism with the position of the axis of rotation of the cover relative to the frame.

This device also presents the disadvantage of not being able to permit use of the mechanism in reverse operation and, if the user pulls on the end of the roll of paper or attempts to cut it using a manual paper cutter, this causes a loss of engagement of the gears, which translates into unpleasant noise and the opening of the cover.

Also known by EP-0 765 761 is a thermal printing mechanism in which lateral orifices of the frame receive the extremities of the axis of the roller. Claws enable closing the cover, in order to avoid that the head become displaced during closing of the cover and move back to its point of minimal pressure, which is never a printing position.

Further, Japan Patent Abstracts Vol. 098 No. 10 of Aug. 31, 1998 discloses a thermal printing mechanism including lateral orifices; the arrangement is such that it is necessary to close the cover to enable the printer to operate by preventing the bearings which carry the roller to rotate around their own axes relative to the frame.

The known devices of the prior art, with the exception of the first mentioned above, are relatively complex in terms of their implementation, a situation which poses problems of mechanical tolerances, particularly when one wishes to use compact devices to reduce their bulk.

Consequently, an objective of the invention is to remedy the disadvantages mentioned above.

One object of the invention is to enable locking and unlocking the roller against the printhead so as to enable easy introduction of the end of the roll of thermal paper between the roller and the printhead.

Another object of the invention is to enable locking and unlocking the roller against the printhead without complicating the device with cam or lever means.

To that end, the invention concerns a thermal printing device wherein each orifice has a profile comprising a shoulder forming a position of unstable equilibrium of the axis of the roller during movement of said axis in said orifices, and said shoulder of unstable equilibrium is arranged between two positions of stable equilibrium of the axis and the roller, at an entry of a top part of the orifices and at a bottom of the orifices in a closed, locked position of the roller, respectively.

The cover, consisting of one or a plurality of articulated elements, supports the roller and enables bringing it to the opening of the top part of the orifices and permits its free movement inside said orifices. The parts of the orifices opposite the printhead are homothetic to each other relative to the axis of rotation of the roller when it is engaged in the base of the orifices.

A first advantage of the invention is that the mechanism can be extremely narrow with a simple clipping system.

The device is such that the parts of the orifices opposite the printhead have a shape which guides the roller from the position of entry on the frame to the printing position such that at the time of movement of the roller, it passes through a position of unstable equilibrium caused by a shoulder generating a friction point and instability point of the roller during movement of its axis in said orifices when it is subject to the pressure of the printhead.

The device is such that one orifice is wider than the other.

The device is such that the shape of the bottom section of the orifice follows a radius of the gear assembly driving the gear assembly integral with the roller.

The device further has a part which moves into place over the gears to protect them and serves to align the roller relative to the gears.

The following description, with reference to the annexed drawings, makes it possible to understand how the invention may be embodied, without in any way restricting it.

Figure 1:
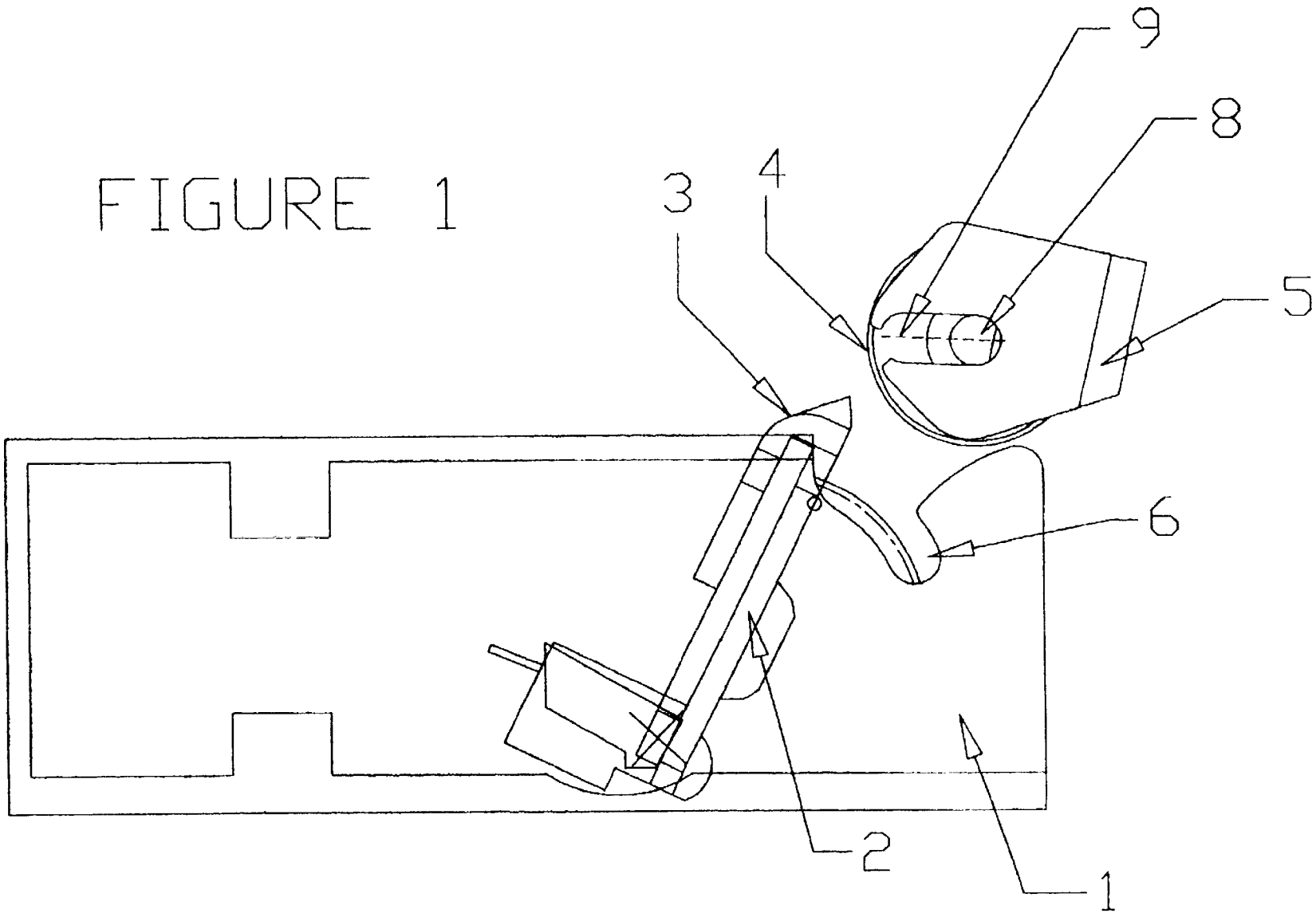
FIG. 1 is a schematic side view of the thermal printing device according to the present invention, in the open position.

FIG. 1 depicts a thermal printing device which includes a frame 1 supporting a motor, a printhead 2, a paper cutter with teeth 3, a driving roller 4 for thermal paper. The printhead 2 is flexibly supported by the section of the frame 1. The driving roller 4 is carried by the cover 5. The device has an orifice 6 on one lateral side and an orifice 7 on the opposite lateral side (see FIG. 4). The orifice 6 is larger than the orifice 7, but homothetic. The driving roller 4 has its rotation axis 8 which is movable along a displacement axis 9 perpendicular to the rotation axis 8 of the roller.

At the time of closing, the cover 5 causes the displacement of the rotation axis 8 of the driving roller 4 and causes it to move in the orifices 6 and 7 from the upper entry of the orifices while permitting its free displacement inside the orifices 6 and 7.

Figure 2:
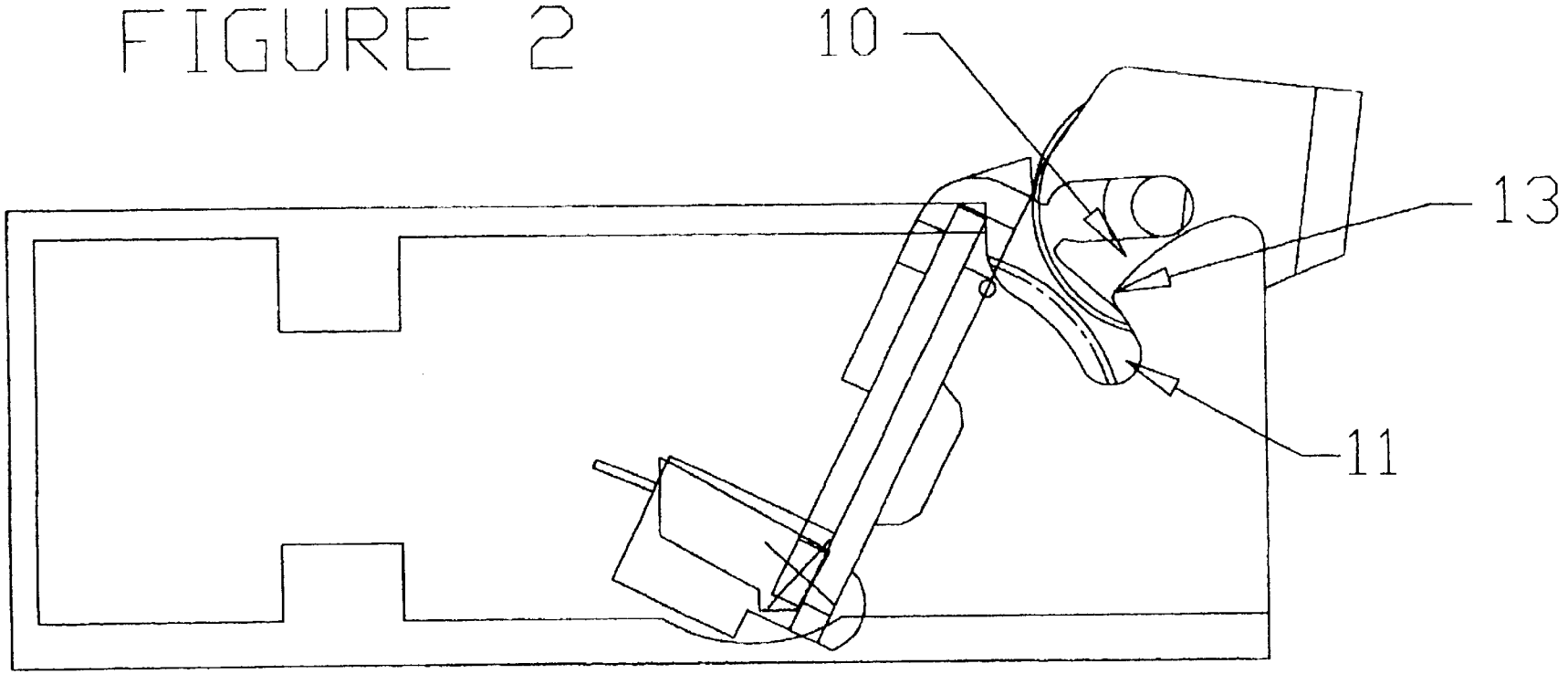
FIG. 2 is a schematic side view of the thermal printing device according to the present invention, at the beginning of its closing.
Figure 3:
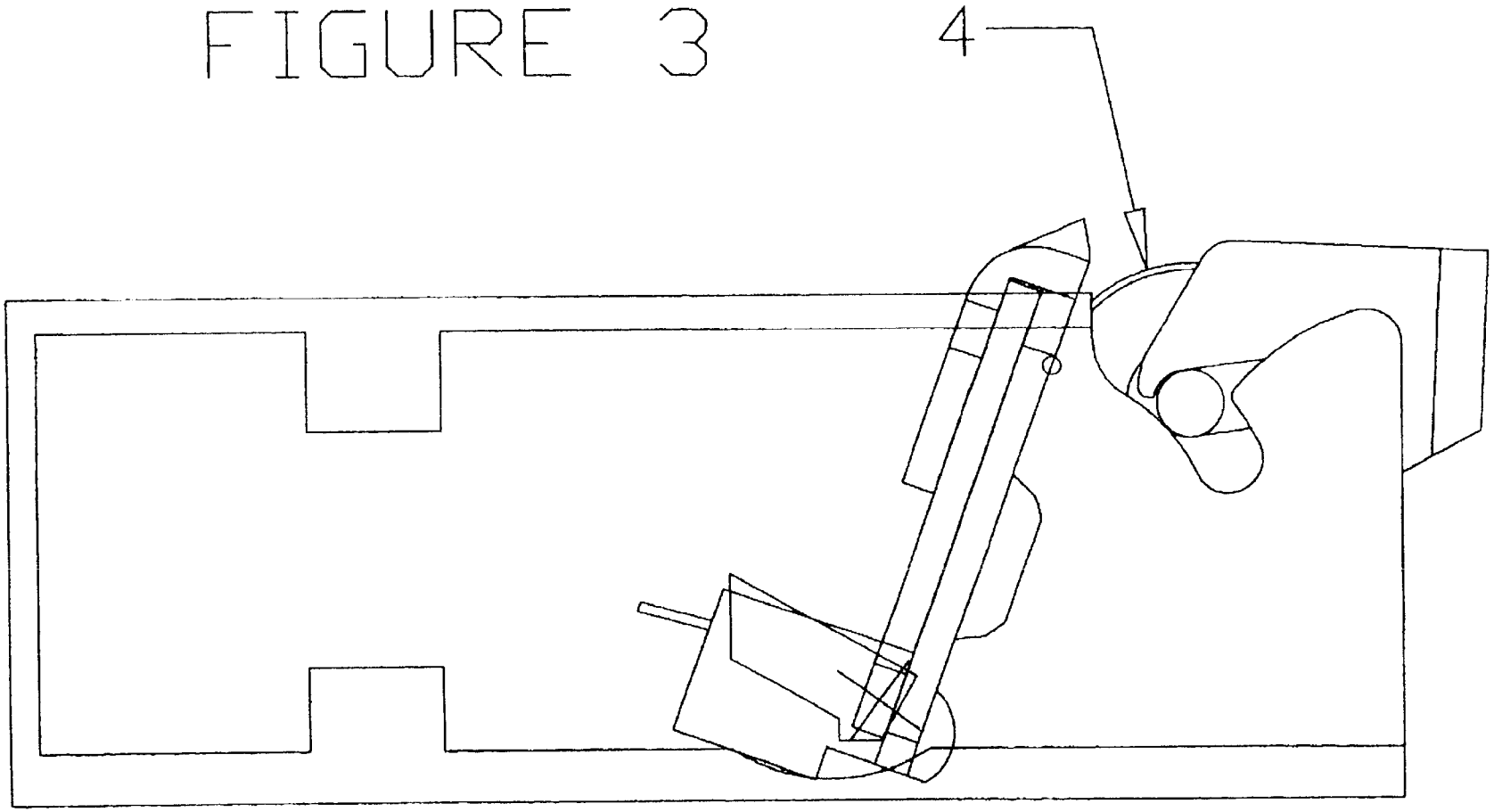
FIG. 3 is a schematic side view of the thermal printing device according to the present invention, at the time of passage over the shoulder forming a point of unstable equilibrium.

It is discernible in FIG. 1 that the rotation axis 8 has its initial position, when open, that it moves to penetrate into the upper section 10 of the orifice 6 and 7, respectively (FIG. 2), and then that during closing, the rotation axis 8 moves toward the lower section 11 of the orifice 6 and 7, respectively, passing over the shoulder of unstable equilibrium 13.

The intersection of the two sections of the orifices 6 and 7 forms the shoulder of unstable equilibrium 13.

Figure 4:
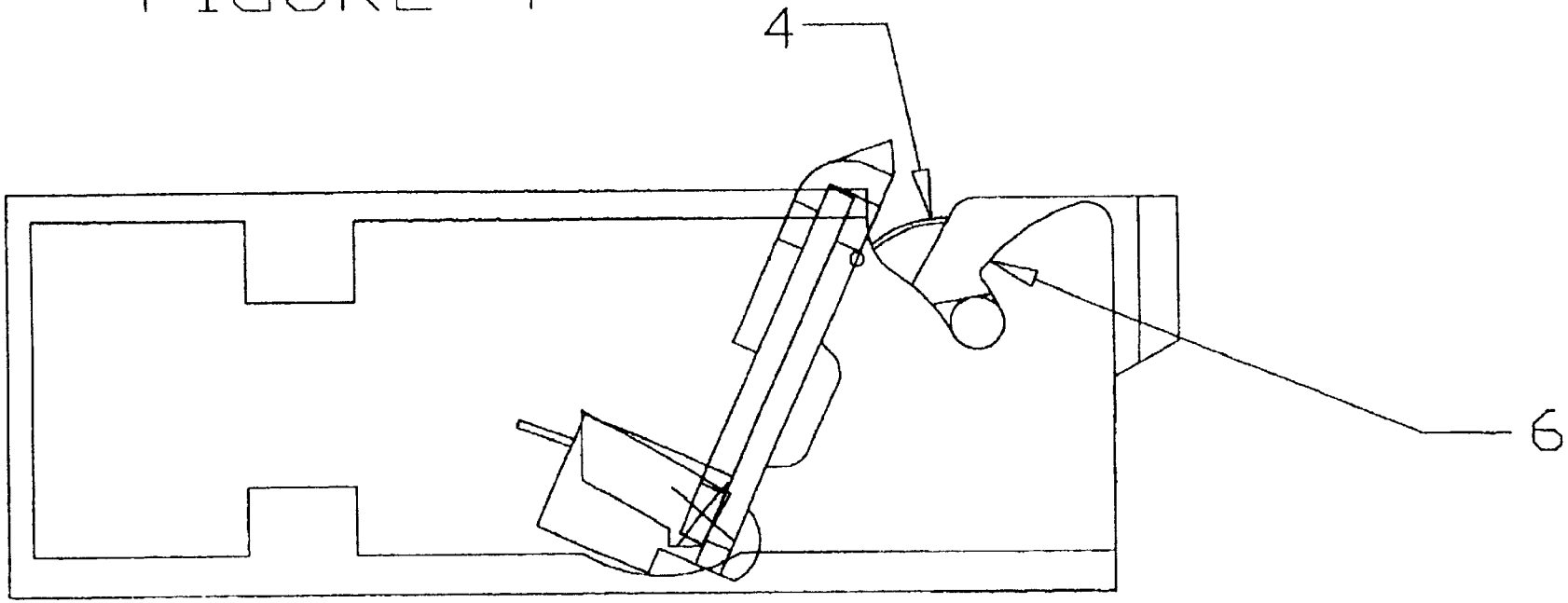
FIG. 4 is the a schematic side view of the thermal printing device according to the present invention, completely closed.
Figure 5:
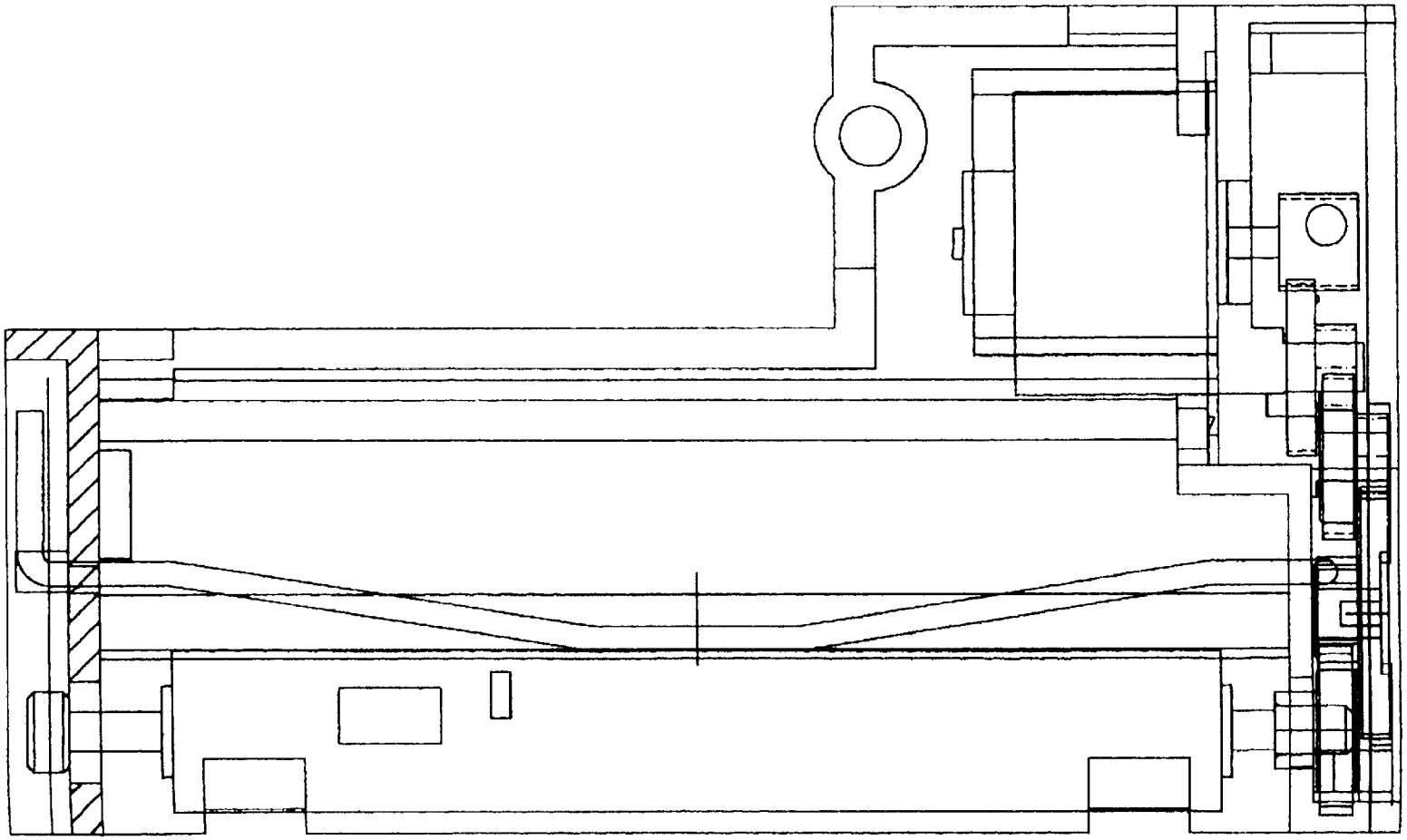
FIG. 5 is a top view of the device according to the invention.
Figure 6:
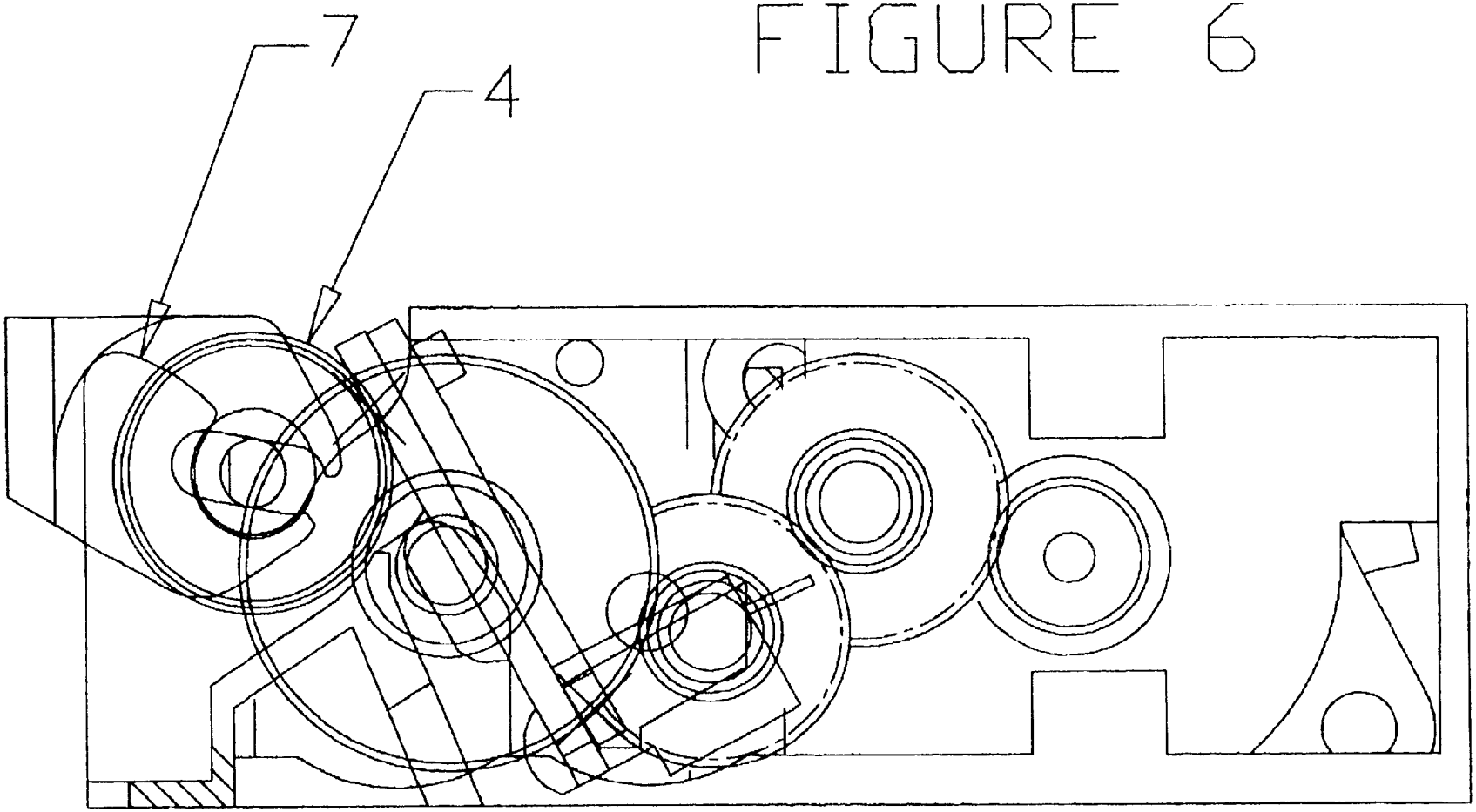
FIG. 6 is a schematic side view of the thermal printing device according to the present invention, completely closed, from the side opposite that of FIG. 4.

As is discernible in FIG. 4, one orifice 7 is larger than the orifice 6, but homothetic.

Figure 7:
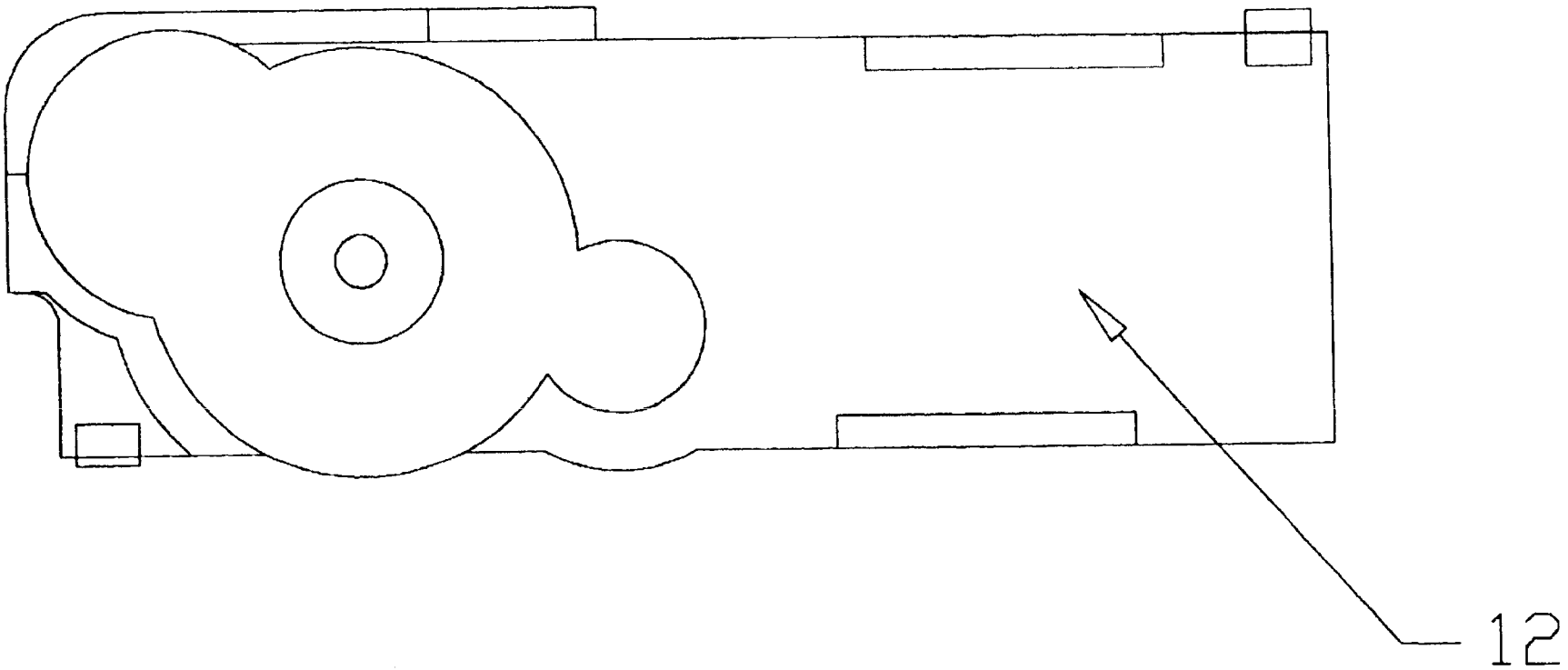
FIG. 7 is a view of the part coming in place over the gears.

FIG. 7 depicts a part 12 which moves into place over the gears to protect them and which has as a function the alignment of the driving roller relative to the gears.

Thus, the device according to present invention is such that the driving roller is movable along an axis perpendicular to its axis of rotation and it has two degrees of freedom relative to the cover.

The position of the driving roller in the closed position is defined by its position at the bottom of the orifice. The cover has no function other than guiding the axis of the driving roller into the orifice of the frame and effecting the displacement of the axis of the driving roller according to one degree of freedom inside the orifice of the frame.

There is no condition between the axes passing through the center of the driving roller and the line of dots of the printhead, on the one hand, and between the rotation axis of the driving roller and the rotation axis of the cover, on the other. This is due to the fact that the locking of the roller does not occur relative to the cover but rather relative to the bottom of the orifice of the frame. Specifically, the cover has only a guiding function for the driving roller in the orifice of the frame.

At the time of closing, it is not the roller that rolls on the printhead but the printhead which pushes it away because of the fact that the roller can retreat into the orifice of the cover and thus pass below the top of the printhead, which is a sharp angle, to move directly to be supported against the flat surface of the printhead. This prevents the teeth of the paper cutter from indenting the material of the driving roller. This movement of the driving roller toward the rear can occur in any position of the device because it is not due to gravity but to the pressure applied by the printhead.

The device is such that it can have one orifice arranged in the cover and one orifice in the frame, on each side of the device.

To improve the engagement of the gears, the lower section of the orifice of the frame adjacent to and behind the shoulder 13 can follow a radius portion whose center is the center of the axis of support of the gear driving the roller gear, and the radius must pass through the rotation axis of the driving roller, in the closed position.

Thus, a first advantage of the device according to the invention is that at the time of closing, the driving roller applies no pressure on the printhead, and thus does not rub against the teeth of a manual paper cutter installed. This prevents penetration of the teeth of the paper cutter into the flexible material driving roller.

A second advantage of the device according to invention is that the locking position of the driving roller when the cover is closed is effected by a combination of the movements of the cover relative to the frame, which unequivocally determines the position relative to the frame. The shape of the orifice of the frame enables firm positioning of the driving roller relative to the frame and thus to the printhead, which is very important for the printing quality.

The orifice of the frame makes it possible to avoid any constraint on the relative positions of the axis passing through the center of the driving roller (or axis of the driving roller) and the line of dots of the printhead and that passing through the axis of the driving roller and the rotation axis of the cover since it is the position in the orifice which determines the closing.

The orifice, and more specifically the lower section located behind the shoulder 13, enables setting the hardness of the locking, which is particularly important if the paper is pulled by the user at the time of manual cutting. The device according to the invention does not open at that time and does not lose the engagement of its gears.

What is claimed is:

1. Thermal printing device comprising a frame, a thermal printhead flexibly mounted on the frame, a driving roller carried by a cover and integral with a gear assembly, the printhead resting on the roller when the device is in a printing position, and two orifices arranged in each lateral side of the frame, in which ends of a rotation axis of the roller can be inserted, wherein each orifice has a profile comprising a shoulder forming a position of unstable equilibrium of the axis of the roller during movement of said axis in said orifices, and said shoulder of unstable equilibrium is arranged between two positions of stable equilibrium of the axis and the roller, at an entry of a top part of the orifices and at a bottom of the orifices in a closed, locked position of the roller, respectively, wherein the cover (i) comprises one or a plurality of articulated elements, (ii) supports the roller so that the roller is movable with respect to the cover along a longitudinal axis perpendicular to the rotation axis of the roller, (iii) enables moving the roller to the entry of the top part of the orifices, and (iv) permits free displacement of the roller inside said orifices.

2. Device according to claim 1, wherein parts of the orifices opposite the printhead are homothetic to each other relative to the rotation axis of the roller when the roller is engaged in the bottom of the orifices, one of the orifices being wider than the other.

3. Device according to claim 2, wherein parts of the orifices opposite the printhead and located behind the shoulder during displacement of the rotation axis of the roller in said orifices when the roller is subjected to the pressure of printing follows a radius portion whose center is a center of an axis of a support of a gear driving a gear integral with the roller, and the radius passes through the axis of rotation of the driving roller, in the closed position.

4. Device according to claim 2, further comprising a part which moves into place over gears driving the roller to protect them and enables the alignment of the roller relative to the gears.

5. Device according to claim 1, wherein parts of the orifices opposite the printhead and located behind the shoulder during displacement of the rotation axis of the roller in said orifices when the roller is subjected to the pressure of printing follows a radius portion whose center is a center of an axis of a support of a gear driving a gear integral with the roller, and the radius passes through the axis of rotation of the driving roller, in the closed position.

6. Device according to claim 1, further comprising a part which moves into place over gears driving the roller to protect them and enables the alignment of the roller relative to the gears.

7. Thermal printing device comprising a frame, a thermal printhead flexibly mounted on the frame, a driving roller carried by a cover and integral with a gear assembly, the printhead resting on the roller when the device is in a printing position, and two orifices arranged in each lateral side of the frame, in which ends of a rotation axis of the roller can be inserted, wherein each orifice has a profile comprising a shoulder forming a position of unstable equilibrium of the axis of the roller during movement of said axis in said orifices, and said shoulder of unstable equilibrium is arranged between two positions of stable equilibrium of the axis and the roller, at an entry of a top part of the orifices and at a bottom of the orifices in a closed, locked position of the roller, respectively, wherein parts of the orifices opposite the printhead are homothetic to each other relative to the rotation axis of the roller when the roller is engaged in the bottom of the orifices, one of the orifices being wider than the other.

8. Device according to claim 7, wherein parts of the orifices opposite the printhead and located behind the shoulder during displacement of the rotation axis of the roller in said orifices when the roller is subjected to the pressure of printing follows a radius portion whose center is a center of an axis of a support of a gear driving a gear integral with the roller, and the radius passes through the axis of rotation of the driving roller, in the closed position.

9. Device according to claim 7, further comprising a part which moves into place over gears driving the roller to protect them and enables the alignment of the roller relative to the gears.

10. Thermal printing device comprising a frame, a thermal printhead flexibly mounted on the frame, a driving roller carried by a cover and integral with a gear assembly, the printhead resting on the roller when the device is in a printing position, and two orifices arranged in each lateral side of the frame, in which ends of a rotation axis of the roller can be inserted, wherein each orifice has a profile comprising a shoulder forming a position of unstable equilibrium of the axis of the roller during movement of said axis in said orifices, and said shoulder of unstable equilibrium is arranged between two positions of stable equilibrium of the axis and the roller, at an entry of a top part of the orifices and at a bottom of the orifices in a closed, locked position of the roller, respectively, wherein parts of the orifices opposite the printhead and located behind the shoulder during displacement of the rotation axis of the roller in said orifices when the roller is subjected to the pressure of printing follows a radius portion whose center is a center of an axis of a support of a gear driving a gear integral with the roller, and the radius passes through the axis of rotation of the driving roller, in the closed position.

* * * * *